US006546608B2

(12) United States Patent
Garner

(10) Patent No.: US 6,546,608 B2
(45) Date of Patent: Apr. 15, 2003

(54) DISPLAY STRIP ASSEMBLY SYSTEM

(76) Inventor: Michael W. Garner, 31390 Easy Ave. SW., Albany, OR (US) 97321

( * ) Notice: Subject to any disclaimer, the term of this patent is extended or adjusted under 35 U.S.C. 154(b) by 0 days.

(21) Appl. No.: 09/990,110

(22) Filed: Nov. 21, 2001

(65) Prior Publication Data

US 2002/0100154 A1 Aug. 1, 2002

Related U.S. Application Data

(60) Provisional application No. 60/250,686, filed on Nov. 30, 2000.

(51) Int. Cl.[7] ..... B23P 23/00

(52) U.S. Cl. ..... 29/33 K; 29/564.1; 29/564.8; 29/715; 29/782

(58) Field of Search ..... 29/33 R, 33 K, 29/564.1, 564.6, 564.7, 564.8, 33 Q, 33 S, 819, 782, 715, 818, 714, 241; 226/88–89; 206/526

(56) References Cited

U.S. PATENT DOCUMENTS

| | | | | |
|---|---|---|---|---|
| 3,390,567 A | | 7/1968 | Frastaci | |
| 4,429,456 A | | 2/1984 | Zahn | |
| 4,754,907 A | | 7/1988 | Taylor | |
| 5,433,060 A | * | 7/1995 | Gur et al. | 53/413 |
| 5,647,118 A | | 7/1997 | Laperriere et al. | |
| 6,195,877 B1 | | 3/2001 | Poulukefalos | |
| 6,283,312 B1 | * | 9/2001 | Edgerton | 211/113 |
| 6,405,778 B1 | * | 6/2002 | Belt | 156/519 |

FOREIGN PATENT DOCUMENTS

WO WO-98/52823 A1 * 11/1998

* cited by examiner

*Primary Examiner*—A. L. Wellington
*Assistant Examiner*—Erica E. Cadugan

(57) ABSTRACT

A display strip assembly system for efficiently assembling bags upon a point of purchase display strip. The display strip assembly system includes a base, an elongate frame mounted to the base extending in an angled manner, a receiving channel within the elongate frame for receiving a length of point of purchase (POP) display strip, a plurality of first apertures and second apertures within the receiving channel aligned with the fingers of the POP display strip, and a elevating unit within the frame for extending a corresponding plurality of first shafts and second shafts through the apertures for extending the fingers of the POP display strip for allowing attachment of a plurality of bags without moving the POP display strip.

20 Claims, 11 Drawing Sheets

DISPLAY STRIP ASSEMBLY SYSTEM

CROSS REFERENCE TO RELATED APPLICATIONS

I hereby claim benefit under Title 35, United States Code, Section 119(e) of U.S. provisional patent application Ser. No. 60/250,686 filed Nov. 30, 2000. The 60/250,686 application is currently pending. The 60/250,686 is incorporated by reference into this patent application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to point of purchase (POP) display strip assemblers and more specifically it relates to a display strip assembly system for efficiently assembling bags upon a point of purchase display strip.

2. Description of the Prior Art

Point of purchase (POP) display strips have been in use for years. POP display strips are basically comprised of an elongate, flat, flexible structure that has a plurality of fingers extending from thereof for receiving a plurality of bags. There are various types of POP display strips which the present invention is capable of being utilized upon. Individuals must manually insert each bag upon the fingers of the POP display strip before providing to a retail store for display.

One example of an assembler device that is utilized for assisting an individual attach bags to the POP display strip is manufactured by North American Plastics Manufacture Company (NAPCO) identified within U.S. Pat. No. 5,647,118. The main problem with the NAPCO product is that it allows for only one bag to be attached to the POP display strip at a time which is inefficient. Examples of other patented devices related to the present invention include U.S. Pat. Nos. 6,195,877, 3,390,567, 4,754,907 and 4,429,456.

While these devices may be suitable for the particular purpose to which they address, they are not as suitable for efficiently assembling bags upon a point of purchase display strip. Conventional POP display strip assemblers are not efficient in the attachment of bags to the POP display strip.

In these respects, the display strip assembly system according to the present invention substantially departs from the conventional concepts and designs of the prior art, and in so doing provides an apparatus primarily developed for the purpose of efficiently assembling bags upon a point of purchase display strip.

SUMMARY OF THE INVENTION

In view of the foregoing disadvantages inherent in the known types of point of purchase display strip assemblers now present in the prior art, the present invention provides a new display strip assembly system construction wherein the same can be utilized for efficiently assembling bags upon a point of purchase display strip.

The general purpose of the present invention, which will be described subsequently in greater detail, is to provide a new display strip assembly system that has many of the advantages of the display strip assemblers mentioned heretofore and many novel features that result in a new display strip assembly system which is not anticipated, rendered obvious, suggested, or even implied by any of the prior art display strip assemblers, either alone or in any combination thereof.

To attain this, the present invention generally comprises a base, an elongate frame mounted to the base extending in an angled manner, a receiving channel within the elongate frame for receiving a length of point of purchase (POP) display strip, a plurality of first apertures and second apertures within the receiving channel aligned with the fingers of the POP display strip, and a elevating unit within the frame for extending a corresponding plurality of first shafts and second shafts through the apertures for extending the fingers of the POP display strip for allowing attachment of a plurality of bags without moving the POP display strip.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a display strip assembly system that will overcome the shortcomings of the prior art devices.

A second object is to provide a display strip assembly system for efficiently assembling bags upon a point of purchase display strip.

Another object is to provide a display strip assembly system that allows for the attachment of a plurality of bags to a POP display strip without requiring moving the POP display strip.

An additional object is to provide a display strip assembly system that reduces the amount of labor required to attach bags and other articles to a POP display strip.

A further object is to provide a display strip assembly system that is easy to utilize and operate for many users.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
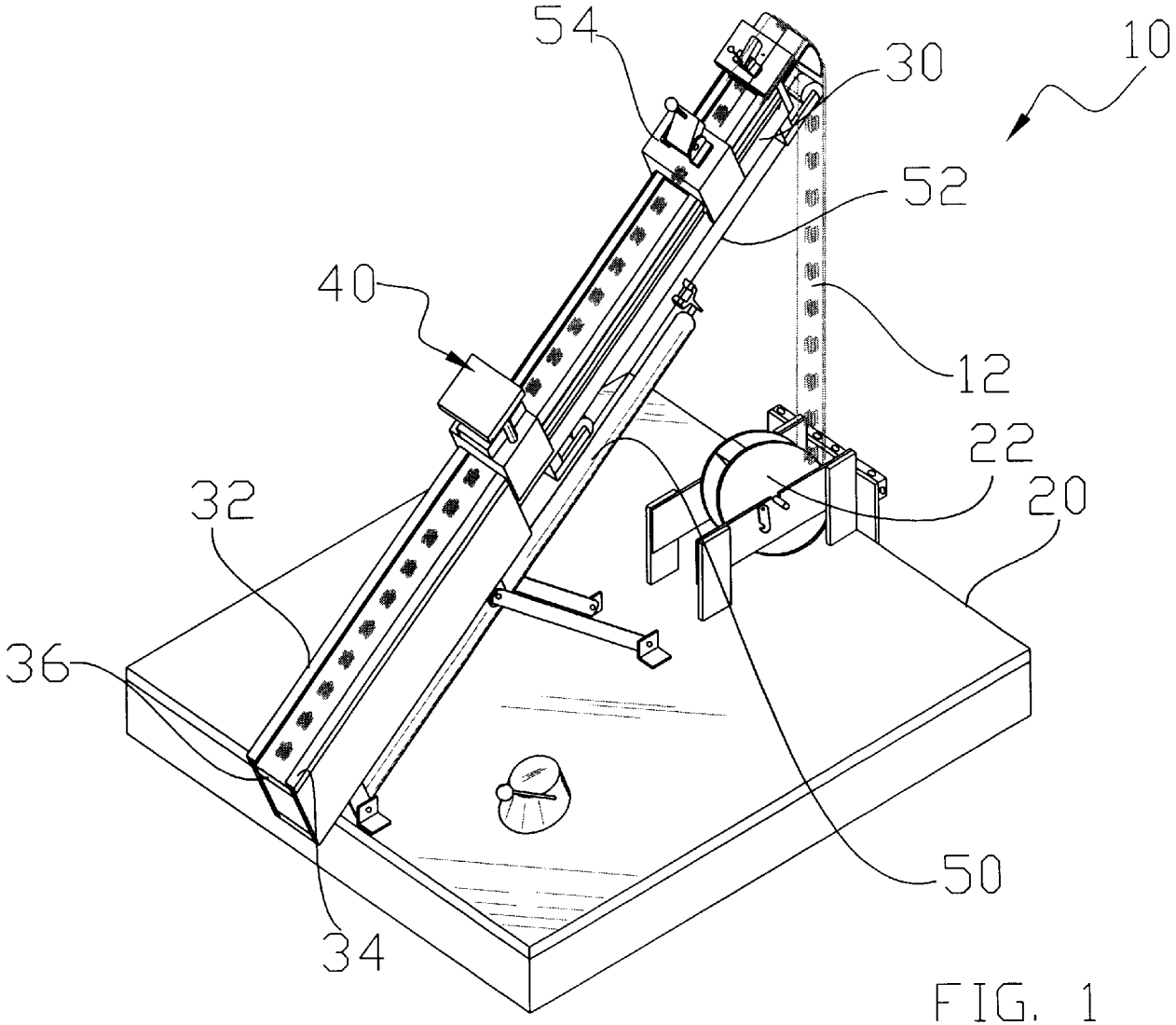
FIG. 1 is an upper perspective view of the present invention with the POP display strip positioned within.

Turning now descriptively to the drawings, in which similar reference characters denote similar elements throughout the several views, FIGS. 1 through 11 illustrate a display strip assembly system 10, which comprises a base 20, an elongate frame 30 mounted to the base 20 extending in an angled manner, a receiving channel within the elongate frame 30 for receiving a length of point of purchase (POP) display strip 12, a plurality of first apertures 38 and second apertures 39 within the receiving channel aligned with the fingers of the POP display strip 12, and a elevating unit within the frame for extending a corresponding plurality of first shafts 62 and second shafts 64 through the apertures for extending the fingers of the POP display strip 12 for allowing attachment of a plurality of bags 19 without moving the POP display strip 12.

As shown in FIGS. 1 through 4 of the drawings, the base 20 is a relatively broad structure designed to support the display strip assembly system 10 in a stable manner. The base 20 may have various shapes, sizes and structures other than illustrated within the figures.

The elongate frame 30 is attached to the base 20 at an upward angle as best shown in FIGS. 1 through 4 of the drawings. The elongate frame 30 may have various shapes, lengths and sizes as can be appreciated. The elongate frame 30 may be attached to the base 20 utilizing various commonly utilized attachment structures such as but not limited to bracing and the like.

Figure 2:
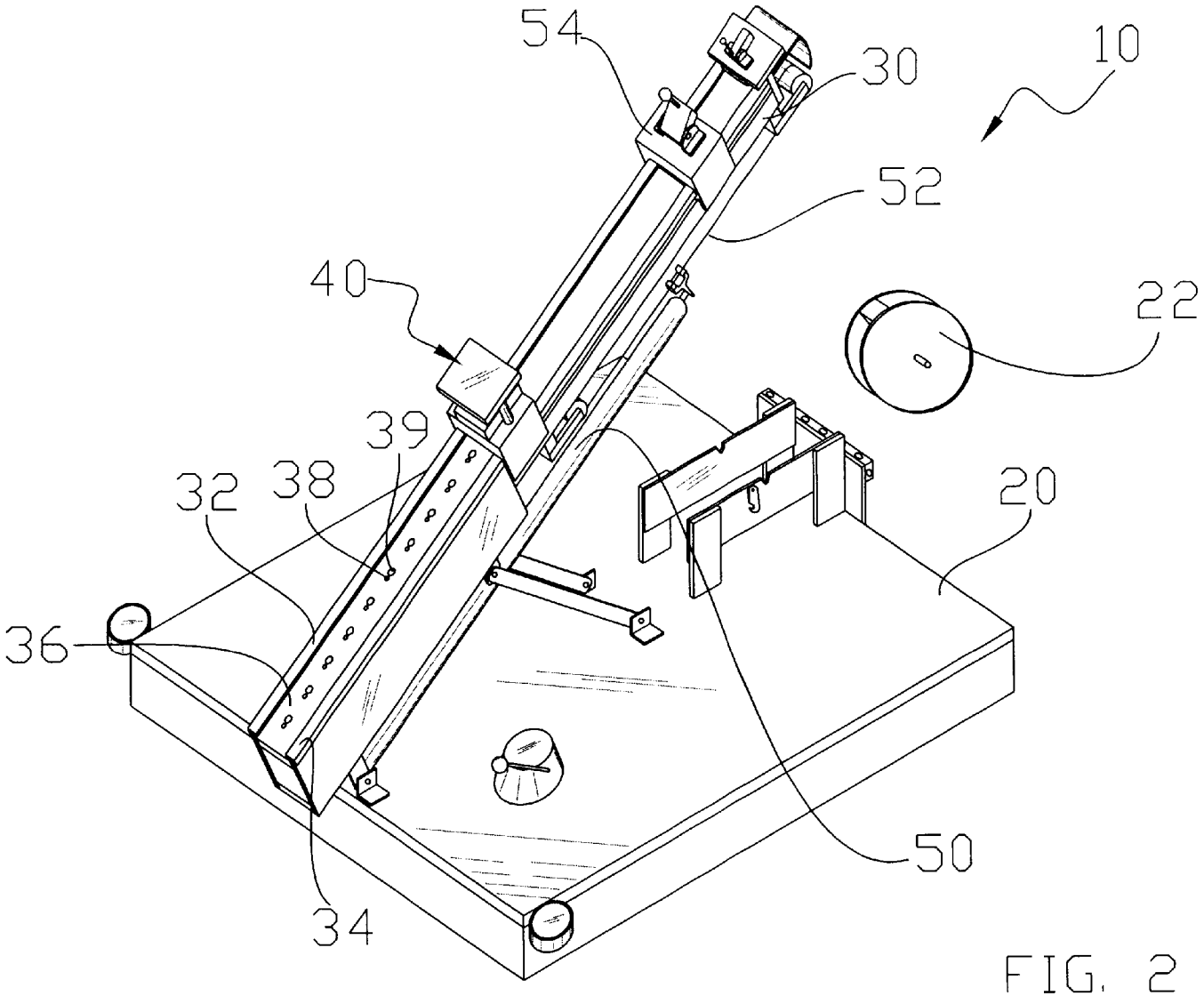
FIG. 2 is an exploded upper perspective view of the present invention.

As shown in FIG. 2 of the drawings, the elongate frame 30 has an upper channel for slidably receiving a length of POP display strip 12 dispensed from a dispensing spool 22 or similar structure. The upper channel is capable of receiving various lengths, widths and thickness of POP display strip 12. The upper channel is formed by an elongate platform 36 extending along the elongate frame 30 partially surrounded by a first lip 32 and a second lip 34 in opposition to the first lip 32. A space between the first lip 32 and the second lip 34 allows for the attachment of the bags 19 to the fingers 14, 16 of the POP display strip 12. The space between the first lip 32 and the second lip 34 is preferably sufficient to avoid interference with the first finger 16 and the second finger 18 of the POP strip being extended. As shown in FIG. 2 of the drawings, the elongate platform 36 includes a plurality of first apertures 38 and second apertures 39 aligned in pairs with one another that correspond to the first fingers 16 and the second fingers 18 of the POP display strip 12 respectively. As shown in FIG. 2 of the drawings, the first aperture 38 is preferably smaller in width than the second aperture 39, however various sizes may be utilized as can be appreciated.

Figure 5:
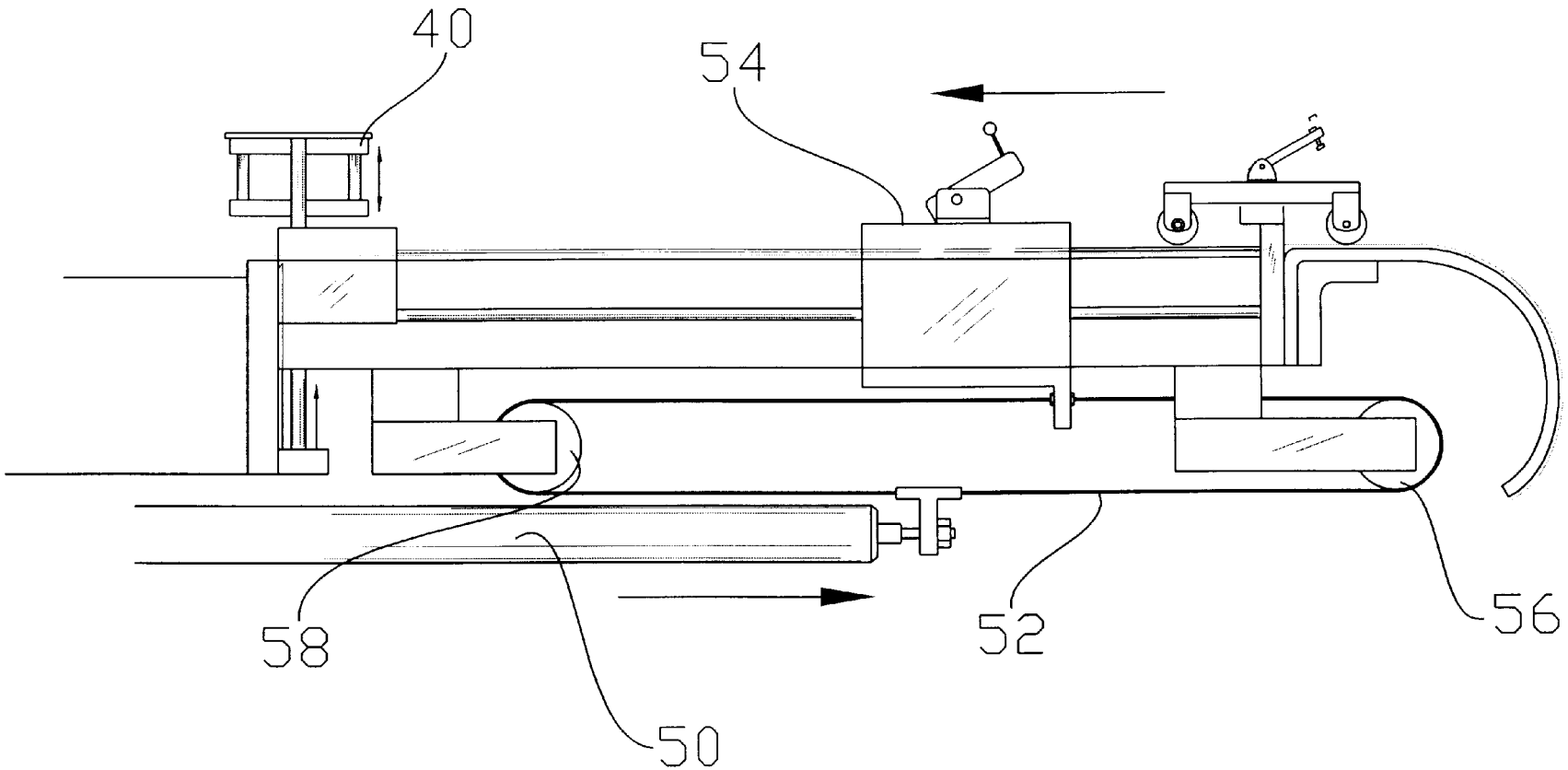
FIG. 5 is a side view of the present invention illustrating the structure for handling the POP displaying strip.
Figure 6:
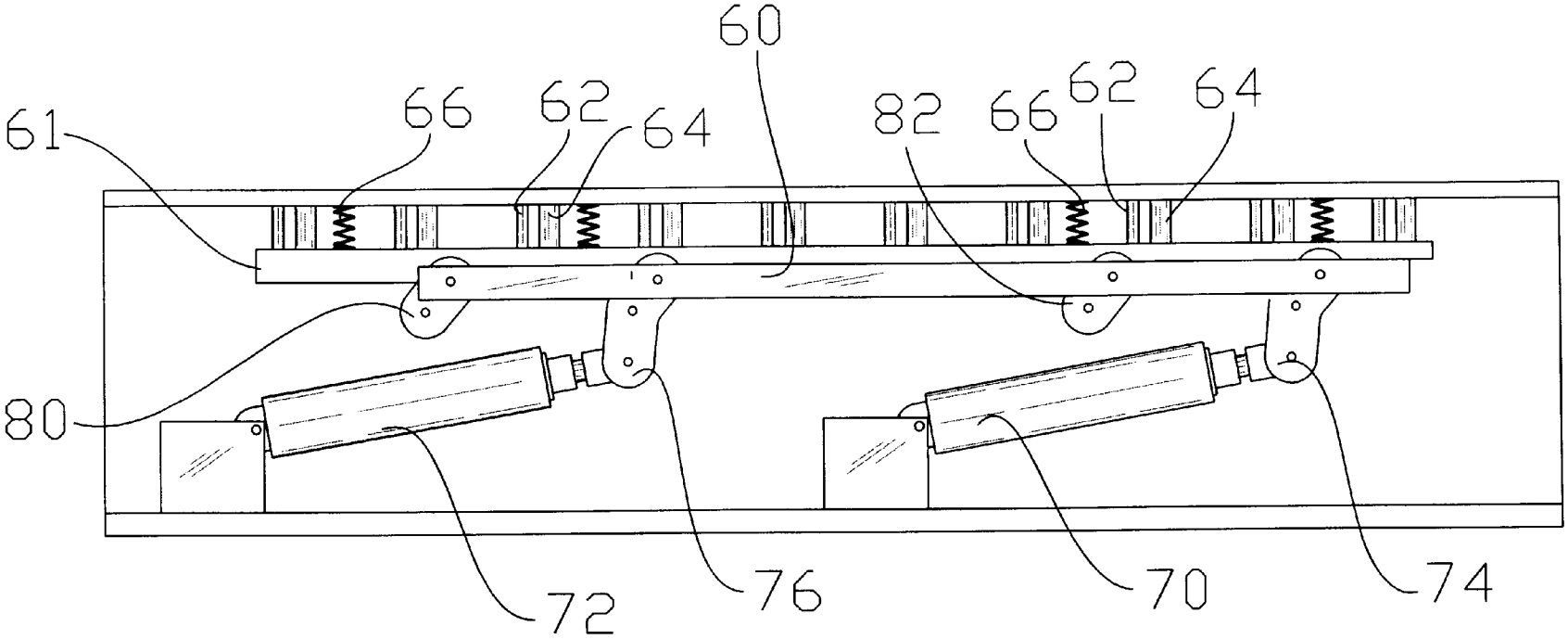
FIG. 6 is a side view of the present invention illustrating the POP display strip finger manipulating structure in the initial position.

As shown in FIG. 5 of the drawings, a first actuator 50 is attached to the elongate frame 30. The first actuator 50 is attached to a cable 52 that is rotatably positioned about a first pulley 56 and a second pulley 58 as further shown in FIG. 5 of the drawings. A gripping unit 54 is slidably positioned about an upper portion of the elongate frame 30 and is connected to the cable 52 thereby allowing the first actuator 50 to move the gripping unit 54 up and down along the elongate frame 30. The gripping unit 54 includes a leverage structure that engages the POP display strip 12 thereby drawing the POP display strip 12 from the dispensing spool 22 and forcing the display strip 12 downwardly along the channel of the elongate frame 30 as shown in FIG. 5 of the drawings. The gripping unit 54 may engage the POP display strip 12 in various manners such as but not limited to frictional engagement, catchably engaging and the like.

As shown in FIGS. 1 through 4 of the drawings, a cutting unit 40 is attached about the elongate frame 30 in a central position above the desired number of bags 19 that are required to be attached to the POP display strip 12. The cutting unit 40 may utilize various cutting means to sever the POP display strip 12 which are well known in the art such as but not limited to a knife structure. The cutting unit 40 may be operated manually or via a power source.

As shown in FIGS. 6 through 9 of the drawings, a first bar member 60 is movably attached to a second bar member 61 by a first guide member 80 and a second guide member 82. The guide members 80, 82 are pivotally attached between the bar members 60, 61 as best shown in FIGS. 1 through 9 of the drawings. The pivotal movement of the guide members 80, 82 allow for the shafts 62, 64 attached to the second bar member 61 to extend through the apertures 38, 39 in a straight manner without moving side to side. A plurality of compression springs 66 are attached between the second bar member 61 and the elongate frame 30 for applying a downward force upon the second bar member 61 thereby forcing the second bar member 61 downwardly when the actuators 70, 72 are allowed to return to a contracted position.

A second actuator 70 and a third actuator 72 are mechanically connected to the first bar member 60 by a first cantilever 74 and a second cantilever 76 respectively as shown in FIGS. 6 through 9 of the drawings. The actuators 50, 70, 72 may be comprised of various structures such as but not limited to pneumatic, hydraulic and electrical. The cantilevers 74, 76 are pivotally attached to the elongate frame 30 in a central manner as shown in FIGS. 6 through 9. It can be appreciated that any number of actuators may be utilized within the present invention. In addition, it can be appreciated that the actuators 70, 72 may be directly connected to the second bar member 61 in a traverse manner for extending the shafts 62, 64 through the apertures 38, 39.

As shown in FIGS. 6 through 9 of the drawings, a plurality of first shafts 62 are attached in a traverse manner to the upper surface of the second bar member 61. As shown in FIGS. 6 through 9 of the drawings, a plurality of second shafts 64 are attached in a traverse manner to the upper surface of the second bar member 61 adjacent to the first shafts 62 in pairs.

Figure 7:
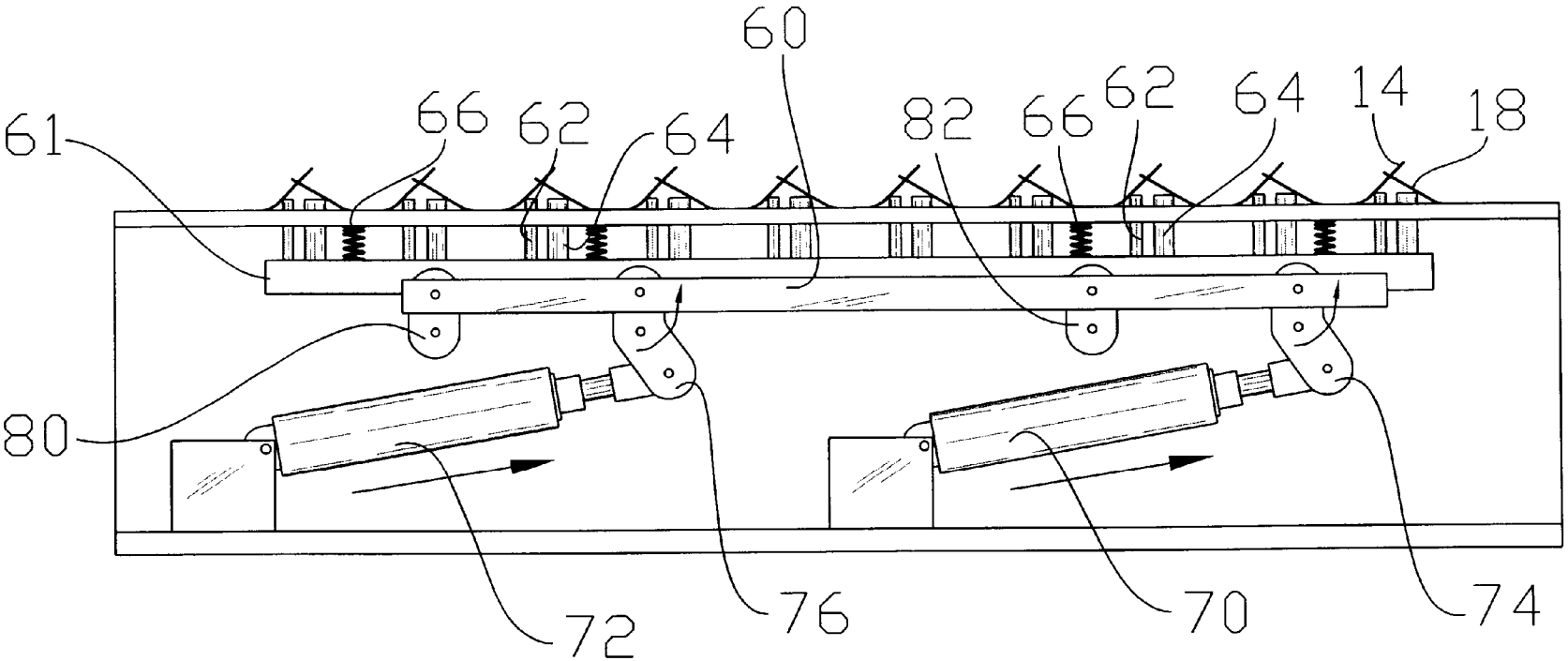
FIG. 7 is a side view of the present invention illustrating the POP display strip finger manipulating structure in the final extended position thereby extending the fingers of the POP display strip.
Figure 8:
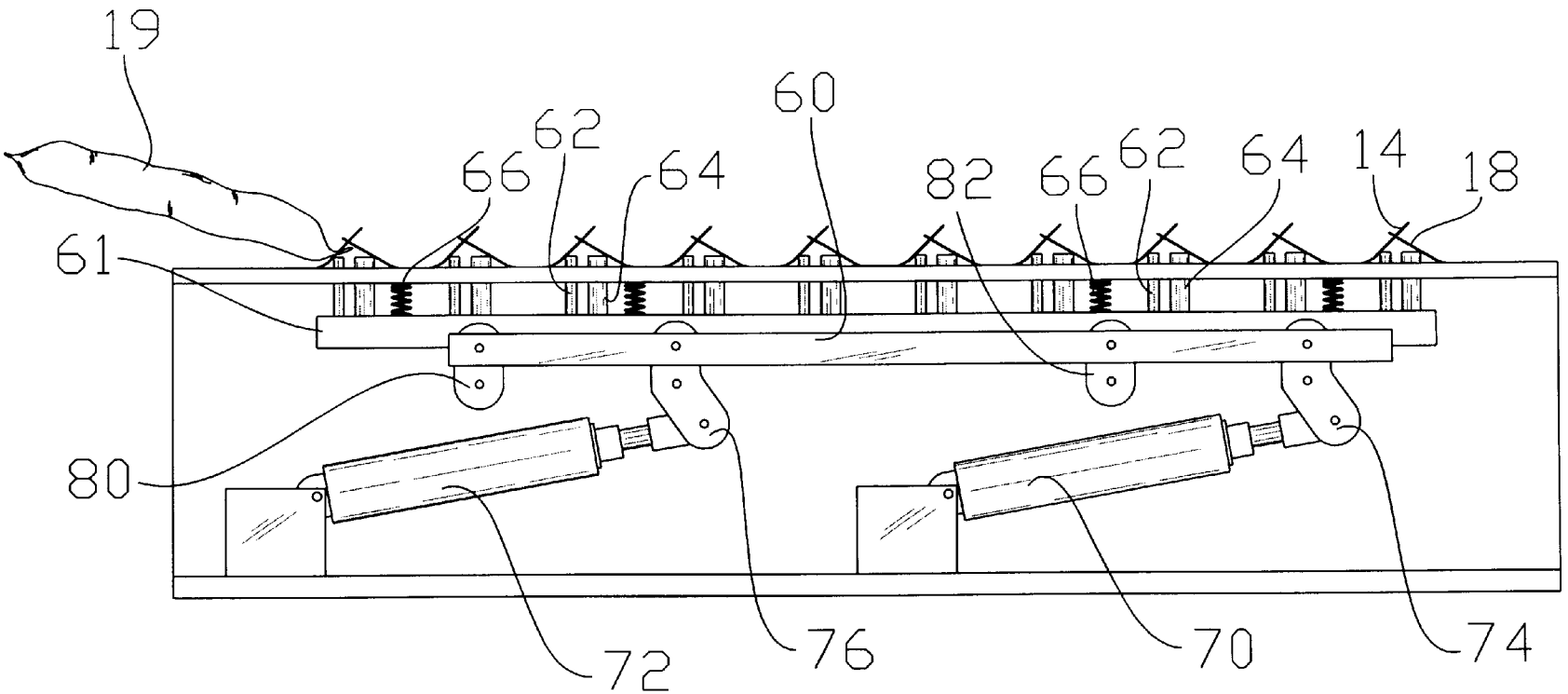
FIG. 8 is a side view of the present invention illustrating the POP display strip finger manipulating structure in the final extended position with a bag positioned about the middle finger.

FIGS. 6 through 9 illustrate the usage of ten pairs of shafts 62, 64, however varying other numbers may be utilized. The first shafts 62 have a smaller width than the second shafts 64 for extending the middle finger 14 of the POP display strip 12 without engaging the first finger 16 and the second finger 18. The second shafts 64 are broader than the first shafts 62 and are formed for engaging the first finger 16 and the second finger 18 of the POP display strip 12 simultaneously to elevate the same away from the body of the POP display strip 12 as shown in FIGS. 7 and 8 of the drawings. The shafts 62, 64 may have various lengths and shapes in order to accomplish the raising and extending of the fingers 14, 16, 18.

Figure 3:
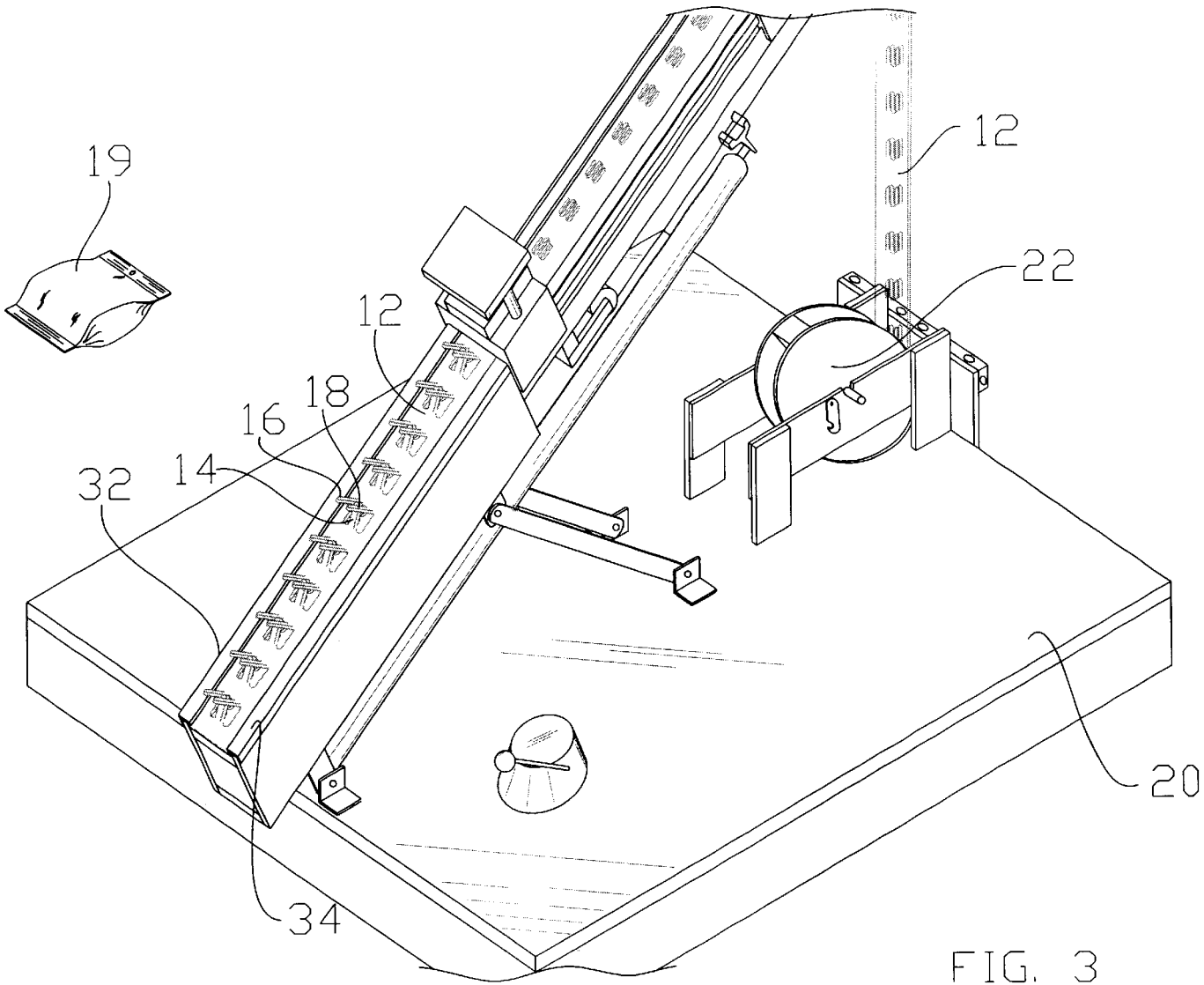
FIG. 3 is a magnified upper perspective view of the present invention with a bag to be attached to the POP display strip.
Figure 4:
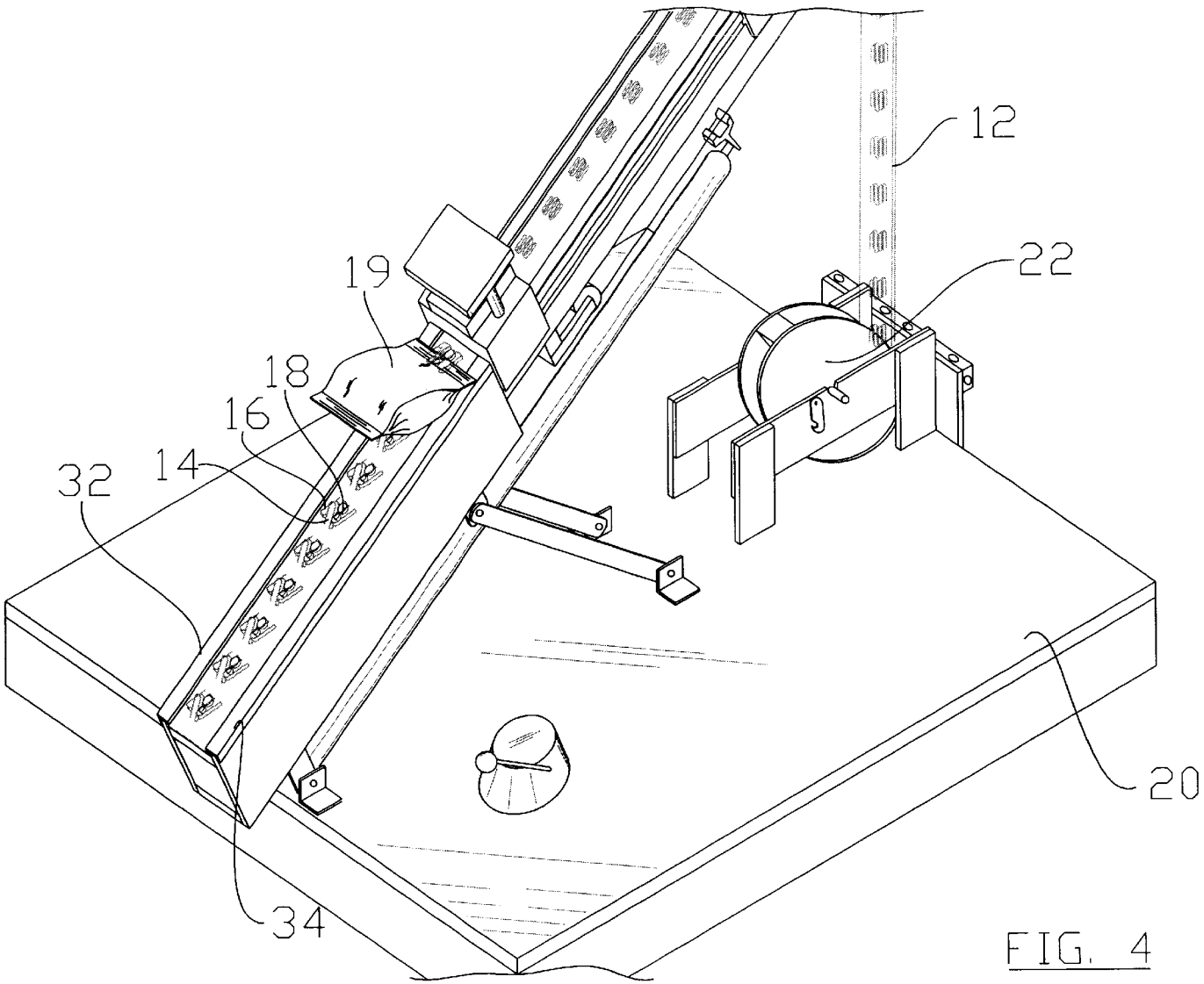
FIG. 4 is a magnified upper perspective view of the present invention with a bag attached to the POP display strip.
Figure 9:
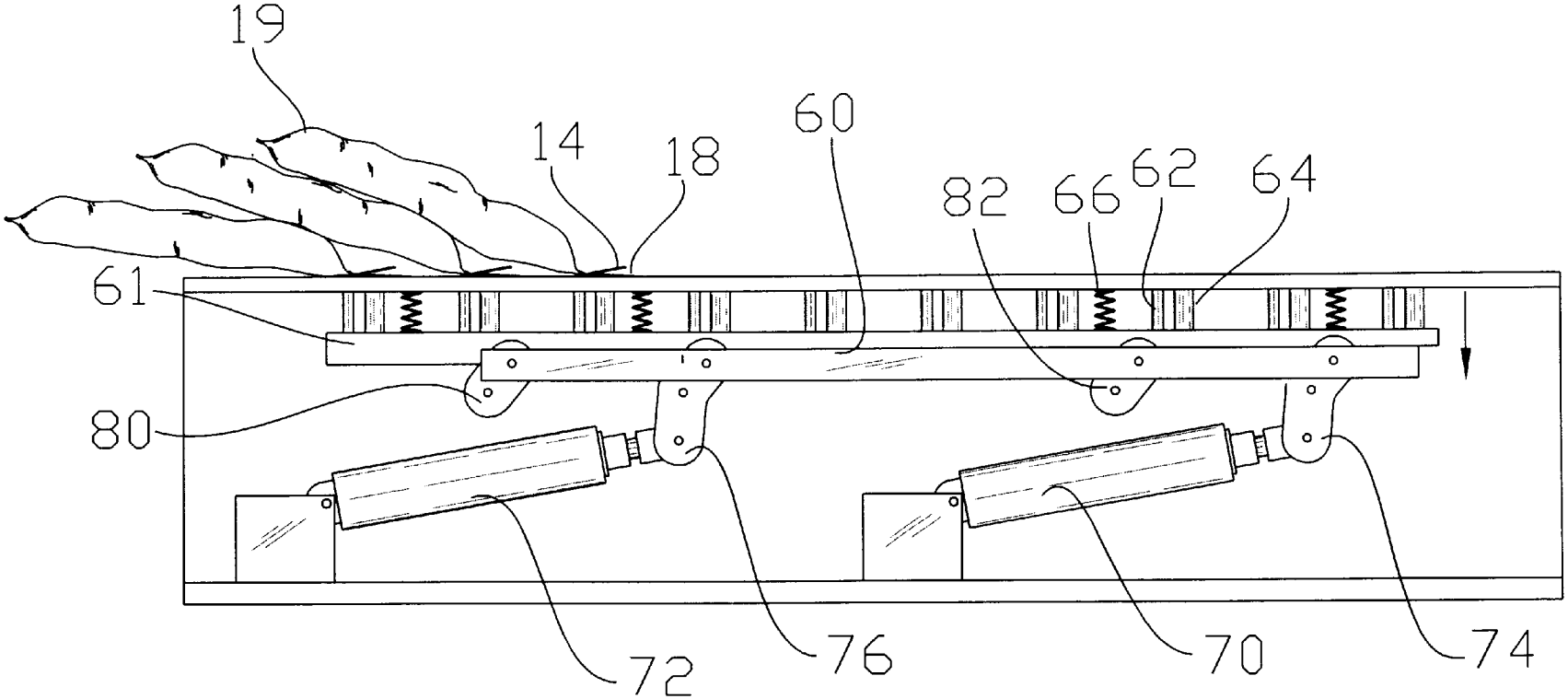
FIG. 9 is a side view of the present invention illustrating the POP display strip finger manipulating structure in the initial contracted position with a plurality of bags attached to the POP display strip.
Figure 10:
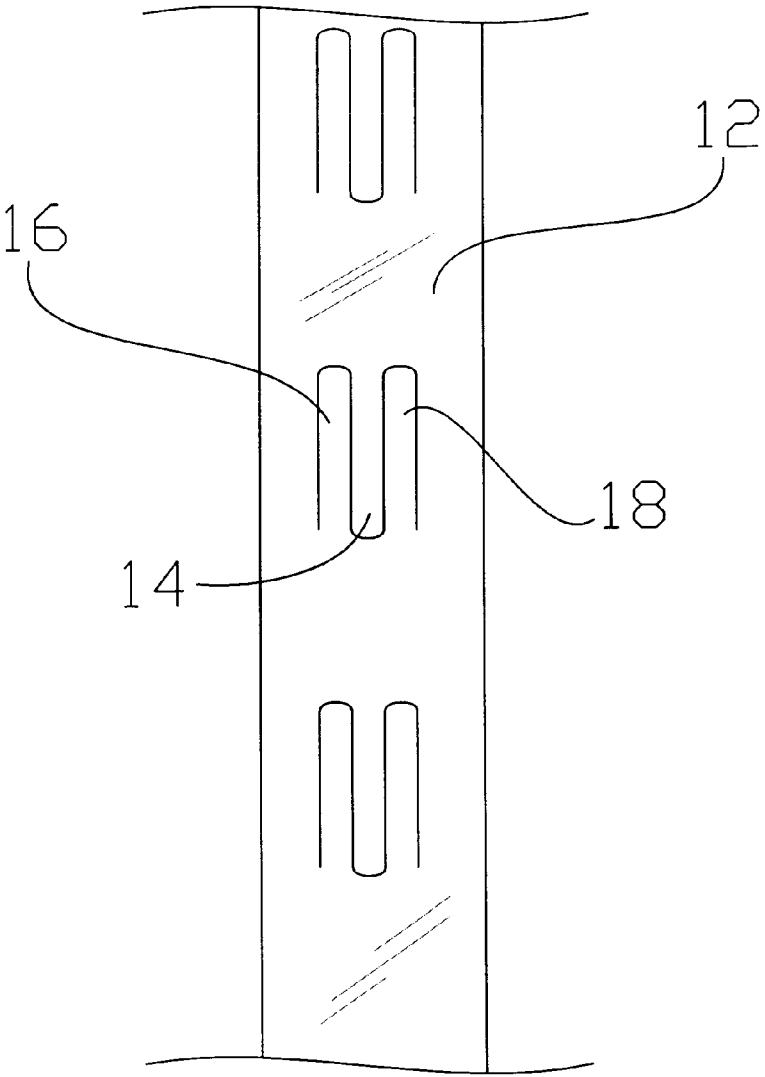
FIG. 10 is a magnified top view of the POP display strip.
Figure 11:
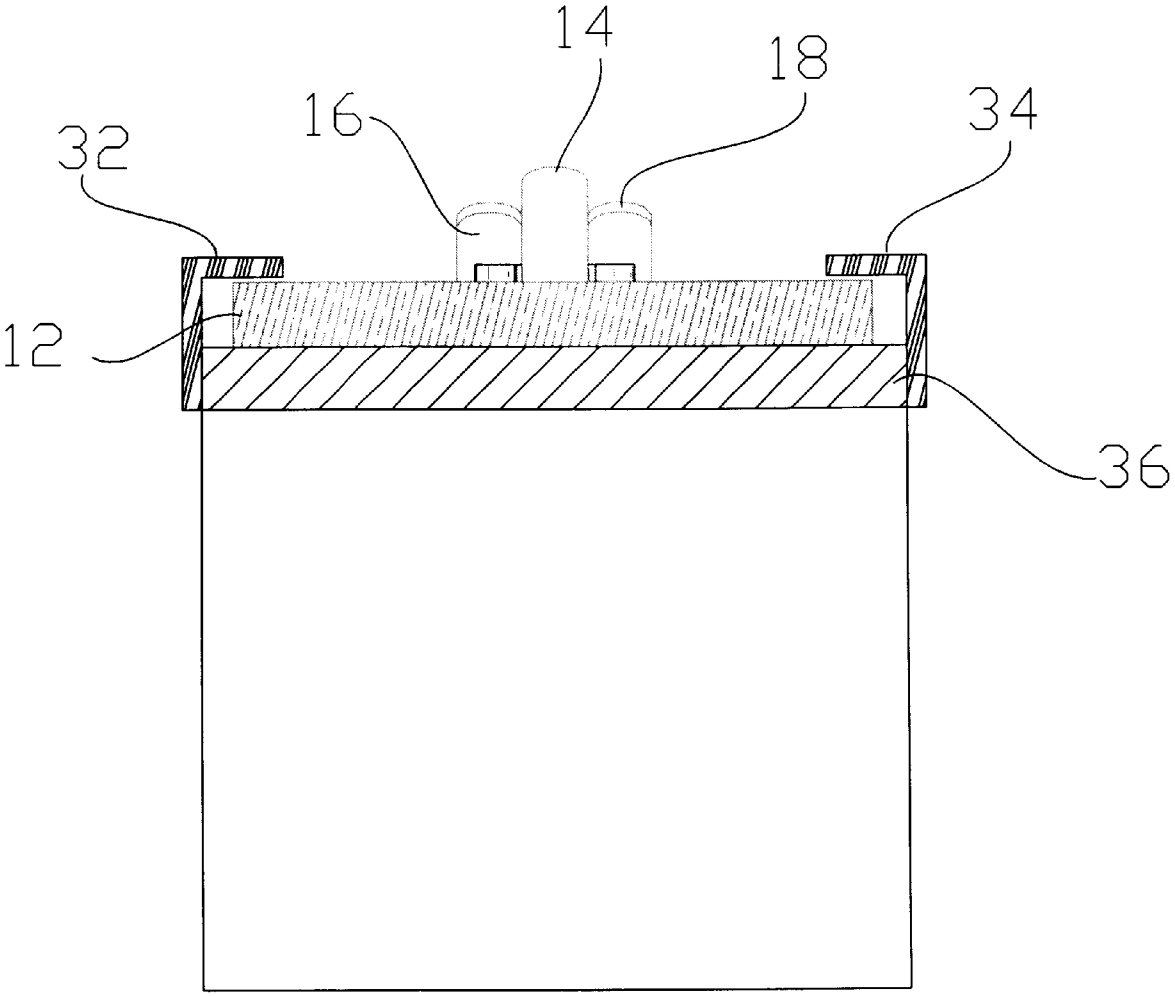
FIG. 11 is an end cutaway view of the frame disclosing the fingers being extended by the plurality of first shafts and the plurality of second shafts.

In use, the user first inserts the POP display strip 12 within the receiving channel of the elongate frame 30. The user then draws the desired length of POP display strip 12 downwardly past the cutting unit 40 of the drawings by actuating the first actuator 50 as shown in FIGS. 1, 3 and 4. The user then operates the second actuator 70 and the third actuator 72 thereby causing the shafts 62, 64 to extend through the apertures 38, 39 within the platform 36 of the elongate frame 30. The shafts 62, 64 continue upwardly thereby engaging the fingers 14, 16, 18 of the POP display strip 12 thereby causing the fingers 14, 16, 18 to extend upwardly and outwardly away from the flat body of the POP display strip 12. Once the fingers 14, 16, 18 are fully extended, the user then positions a bag 19 upon the middle finger 14 by positioning a receiver hole within the bag 19 upon the middle finger 14 as shown in FIG. 8 of the drawings. The user continues this process until all of the middle fingers 14 have a bag 19 attached thereto. Once the bags 19 are attached to the POP display strip 12, the user then actuates the second actuator 70 and the third actuator 72 to lower the shafts 62, 64 thereby causing the fingers 14, 16, 18 to lower upon the bags 19 thereby locking the bags 19 upon them as shown in FIG. 9 of the drawings. Once the shafts 62, 64 have been fully contracted within the platform 36, the user then operates the cutting unit 40 to sever the POP display strip 12 thereby allowing the user to remove the severed POP display strip 12 along with the attached bags 19. The user then repeats the above process as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Display Strip Assembly System

☐ ENVIRONMENTAL ELEMENTS

| | |
|---|---|
| ☐ | ☐ 40. Cutting Unit |
| ☐ | ☐ 41. |
| ☐ | ☐ 42. |
| ☐ | ☐ 43. |
| ☐ | ☐ 44. |
| ☐ | ☐ 45. |
| ☐ | ☐ 46. |
| ☐ | ☐ 47. |
| ☐ | ☐ 48. |
| ☐ | ☐ 49. |
| ☐ 10. Display Strip Assembly System | ☐ 50. First Actuator |
| ☐ 11. | ☐ 51. |
| ☐ 12. Display Strip | ☐ 52. Cable |
| ☐ 13. | ☐ 53. |
| ☐ 14. Middle Finger | ☐ 54. Gripping Unit |
| ☐ 15. | ☐ 55. |
| ☐ 16. First Finger | ☐ 56. First Pulley |
| ☐ 17. | ☐ 57. |
| ☐ 18. Second Finger | ☐ 58. Second Pulley |
| ☐ 19. Bags | ☐ 59. |
| ☐ 20. Base | ☐ 60. First Bar Member |
| ☐ 21. | ☐ 61. Second Bar Member |
| ☐ 22. Dispensing Spool | ☐ 62. First Shaft |
| ☐ 23. | ☐ 63. |
| ☐ 24. | ☐ 64. Second Shaft |
| ☐ 25. | ☐ 65. |
| ☐ 26. | ☐ 66. Compression Spring |
| ☐ 27. | ☐ 67. |
| ☐ 28. | ☐ 68. |
| ☐ 29. | ☐ 69. |
| ☐ 30. Elongate Frame | ☐ 70. Second Actuator |
| ☐ 31. | ☐ 71. |
| ☐ 32. First Lip | ☐ 72. Third Actuator |
| ☐ 33. | ☐ 73. |
| ☐ 34. Second Lip | ☐ 74. First Cantilever |
| ☐ 35. | ☐ 75. |
| ☐ 36. Platform | ☐ 76. Second Cantilever |
| ☐ 37. | ☐ 77. |
| ☐ 38. First Aperture | ☐ 78. |
| ☐ 39. Second Aperture | ☐ 79. |
| ☐ | ☐ 80. First Guide Member |
| ☐ | ☐ 81. |
| ☐ | ☐ 82. Second Guide Member |

I claim:

1. A display strip assembly system, comprising:

a base;

an elongate frame attached to said base;

a receiver channel within said elongate frame for receiving a length of display strip;

a plurality of first apertures within said receiver channel;

a plurality of second apertures within said receiver channel, wherein said plurality of second apertures are aligned with said plurality of first apertures in groups of two wherein said first apertures are aligned with a plurality of middle fingers of said display strip and wherein said second apertures are aligned with a plurality of first fingers and second fingers of said display strip;

a push bar member positioned within said elongate frame below said receiver channel;

a plurality of first shafts and a plurality of second shafts extending from said push bar member for extending through said plurality of first apertures and said second apertures respectively; and an extension unit attached to said push bar member for extending and contracting said push bar member.

2. The display strip assembly system of claim 1, wherein said second shafts are broader than said first shafts for simultaneously engaging said first fingers and said second fingers of said display strip.

3. The display strip assembly system of claim 1, wherein said groups of two are comprised of ten groups.

4. The display strip assembly system of claim 1, wherein said extension unit is comprised of:

a first bar member attached to said push bar member by a plurality of pivotally attached guide members; and a plurality of actuators mechanically attached to said first bar member by a plurality of cantilever members, wherein said cantilever members are pivotally attached to said frame upon a pivot point.

5. The display strip assembly system of claim 4, including a plurality of compression springs positioned between said push bar member and said receiver channel.

6. The display strip assembly system of claim 1, wherein said first shafts are narrower than a width of said middle fingers of said display strip.

7. The display strip assembly system of claim 1, wherein said receiver channel is comprised of an elongate platform, a first lip attached to said elongate platform, and a second lip attached to said elongate platform opposite of said first lip for receiving said length of display strip.

8. The display strip assembly system of claim 1, including a cutting unit attached to said elongate frame a sufficient distance along said elongate frame for allowing at least five bags to be attached to said display strip.

9. The display strip assembly system of claim 1, including a plurality of compression springs positioned between said push bar member and said receiver channel.

10. The display strip assembly system of claim 1, wherein said first apertures and said second apertures are aligned along a common longitudinal axis that is centrally positioned within said receiver channel.

11. A display strip assembly system, comprising:

an elongate frame;

a receiver channel within said elongate frame for receiving a length of display strip;

a plurality of first apertures within said receiver channel;

a plurality of second apertures within said receiver channel, wherein said plurality of second apertures are aligned with said plurality of first apertures in groups of two wherein said first apertures are aligned with a plurality of middle fingers of said display strip and wherein said second apertures are aligned with a plurality of first fingers and second fingers of said display strip;

a push bar member positioned within said elongate frame below said receiver channel;

a plurality of first shafts and a plurality of second shafts extending from said push bar member for extending through said plurality of first apertures and said second apertures respectively; and an extension unit attached to said push bar member for extending and contracting said push bar member.

12. The display strip assembly system of claim 11, wherein said second shafts are broader than said first shafts for simultaneously engaging said first fingers and said second fingers of said display strip.

13. The display strip assembly system of claim 11, wherein said groups of two are comprised of ten groups.

14. The display strip assembly system of claim 11, wherein said extension unit is comprised of:

a first bar member attached to said push bar member by a plurality of pivotally attached guide members; and a plurality of actuators mechanically attached to said first bar member by a plurality of cantilever members, wherein said cantilever members are pivotally attached to said frame upon a pivot point.

15. The display strip assembly system of claim 14, including a plurality of compression springs positioned between said push bar member and said receiver channel.

16. The display strip assembly system of claim 11, wherein said first shafts are narrower than a width of said middle fingers of said display strip.

17. The display strip assembly system of claim 11, wherein said receiver channel is comprised of an elongate platform, a first lip attached to said elongate platform, and a second lip attached to said elongate platform opposite of said first lip for receiving said length of display strip.

18. The display strip assembly system of claim 11, including a cutting unit attached to said elongate frame a sufficient distance along said elongate frame for allowing at least five bags to be attached to said display strip.

19. The display strip assembly system of claim 11, wherein said first apertures and said second apertures are aligned along a common longitudinal axis that is centrally positioned within said receiver channel.

20. A display strip assembly system, comprising:

an elongate frame;

a receiver channel within said elongate frame for receiving a length of display strip;

a plurality of first apertures within said receiver channel;

a plurality of second apertures within said receiver channel, wherein said plurality of second apertures are aligned with said plurality of first apertures in groups of two wherein said first apertures are aligned with a plurality of middle fingers of said display strip and wherein said second apertures are aligned with a plurality of first fingers and second fingers of said display strip;

a push bar member positioned within said elongate frame below said receiver channel;

a plurality of first shafts and a plurality of second shafts extending from said push bar member for extending through said plurality of first apertures and said second apertures respectively;

an extension unit attached to said push bar member for extending and contracting said push bar member;

a first actuator attached to said frame;

a length of cable attached to said first actuator, wherein said length of cable is positioned about a first pulley and a second pulley; and a gripping unit slidably positioned upon said elongate frame for engaging said display strip, wherein said gripping unit is attached to said length of cable.

* * * * *